US007778594B2

(12) United States Patent
Childers et al.

(10) Patent No.: US 7,778,594 B2
(45) Date of Patent: Aug. 17, 2010

(54) PAGER AND MOBILE COMMUNICATIONS SYSTEM AND METHOD

(75) Inventors: Garrett D. Childers, 1145 Spatz Cir., Conway, AR (US) 72034; Ashley Childers, Conway, AR (US); Kevin Miller, Little Rock, AR (US); Gary Childers, Little Rock, AR (US)

(73) Assignee: Garrett D. Childers, Conway, AR (US)

( * ) Notice: Subject to any disclaimer, the term of this patent is extended or adjusted under 35 U.S.C. 154(b) by 900 days.

(21) Appl. No.: 11/438,730

(22) Filed: May 22, 2006

(65) Prior Publication Data

US 2007/0077883 A1 Apr. 5, 2007

Related U.S. Application Data

(60) Provisional application No. 60/683,429, filed on May 20, 2005.

(51) Int. Cl.
*H04H 1/00* (2006.01)

(52) U.S. Cl. ..... 455/3.05; 455/458; 455/460; 455/466; 455/414.1

(58) Field of Classification Search ..... 455/3.05, 455/458, 460, 70, 321, 466, 414.1; 340/7.55, 340/7.63, 286.09, 311.1, 825.44
See application file for complete search history.

(56) References Cited

U.S. PATENT DOCUMENTS 5,757,279 A 5/1998 Fujiwara
D396,466 S 7/1998 Sibbitt
5,999,088 A * 12/1999 Sibbitt ..... 340/7.55
6,573,824 B1 6/2003 Lovegreen et al.
6,636,835 B2 10/2003 Ragsdale-Elliott et al.
6,681,109 B1 * 1/2004 Leifer ..... 455/414.1
6,782,974 B2 8/2004 Leifer
D506,743 S * 6/2005 Cadet ..... D14/191
7,236,087 B2 6/2007 Vasquez et al.
2001/0052841 A1 12/2001 Polyakov
2002/0105412 A1 8/2002 Carissimo
2002/0147647 A1 10/2002 Ragsdale-Elliott et al.
2002/0167416 A1 11/2002 Polyakov
2003/0088469 A1 5/2003 Leifer
2003/0171126 A1 * 9/2003 Blink et al. ..... 455/458
2003/0181201 A1 9/2003 Bomze et al.
2003/0213840 A1 11/2003 Livingston et al.
2003/0218535 A1 11/2003 Khoshbin
2004/0104808 A1 6/2004 Khoshbin
2004/0135671 A1 7/2004 Khoshbin et al.
2004/0201452 A1 * 10/2004 Fisher ..... 340/7.63
2005/0046548 A1 * 3/2005 Foster et al. ..... 340/286.09
2006/0017542 A1 * 1/2006 Holloway et al. ..... 340/7.55

* cited by examiner

*Primary Examiner*—Charles N Appiah
*Assistant Examiner*—Michael T Vu
(74) *Attorney, Agent, or Firm*—J. Charles Dougherty

(57) ABSTRACT

A paging and mobile communications system and method is disclosed whereby entertainment, news, and other timely information may be delivered to a service recipient through a pager while the service recipient is waiting for service. A master unit delivers information to base units associated with each service provider subscribing to the system, and a plurality of pager units are associated with each base unit. The pager units may allow two-way communication with the base unit, whereby games and other interactive content may be delivered to the service recipient using the paging unit. Advertising may be delivered to service recipients through the system, thereby providing an additional revenue flow to the subscriber.

12 Claims, 5 Drawing Sheets

PAGER AND MOBILE COMMUNICATIONS SYSTEM AND METHOD

This application claims the benefit of U.S. provisional patent application No. 60/683,429, filed May 20, 2005, and entitled "Paging System and Method."The entire disclosure of such provisional patent application is hereby incorporated by reference herein.

The present invention relates to pager and mobile communication systems and methods, and in particular to such systems and methods that are adapted for use by service providers to alert service recipients when a desired service is available while also providing additional information, entertainment, or advertising to the service recipients while waiting for the service to become available.

BACKGROUND OF THE INVENTION

An estimated 13 billion customers are served annually in full-service restaurants in the United States. The average wait time for a table at such restaurants during the peak hours when most customers arrive is estimated at 45 minutes. Since most restaurants will not hold a table for a patron if the patron leaves the area, the patron must wait at the restaurant for a table to become available. These long wait times can become tedious for the customer. At peak times, the restaurant may not have adequate space to accommodate all waiting customers, and waiting customers may thus be crowded or forced to stand for long periods, furthering the frustration felt by the customer due to the long wait. It is not known how many customers walked out of restaurants because the estimated wait time to be seated is too long, or who leave after waiting a certain period and no table is made available, although this number is thought to be very large. Stopping or reducing this loss of customer revenue is a matter of great importance to the restaurant industry. Many other service industries may also require service recipients to endure long wait times; for example, it is estimated that the average wait time for a patient in a non-emergency healthcare setting is between 20 minutes and 1 hour. While patients are perhaps less likely to forego medical treatment due to a long wait time than a restaurant customer is to forego seating at a particular restaurant, the results of doing so may be deleterious to the patient's health if, for example, a dangerous condition is left untreated.

It is a common practice today at many busier restaurants and other service providers to use specialized customer pager systems. The purpose of the pager system is to alert the customer when a table is available. In a crowded, noisy restaurant environment, these pager systems allow the customer to enter the bar area, wait outside, or otherwise move about in the general vicinity of the restaurant without fear that the customer will miss his or her table when it becomes available. The pager system thus allows the restaurant manager to more easily ensure that customers are seated in an orderly and efficient manner. Typically, the pager system comprises two types of components, a base unit and multiple individual pagers. The base unit sends a signal to the appropriate pager, and then that pager may light up, blink, vibrate, or emit an audible alert to indicate to the customer that a table is ready. Such systems are provided by various companies, including JTECH Communications, Inc. of Boca Raton, Fla. While such paging systems are useful for indicating to a customer when a table is ready in a noisy and crowded restaurant environment, they do little to alleviate the tedium of waiting for a table, or otherwise encourage a customer to wait for a table despite a significant delay, instead of simply seeking another restaurant or foregoing the dining out experience altogether.

The prior art does include attempts to alleviate the boredom of a customer waiting for a table at a restaurant. U.S. Pat. No. 5,999,088 to Sibbitt teaches an information display pager device that also provides active entertainment for persons waiting for service, such as at a restaurant. The pager features an active display, such as an LCD screen, and a static display, such as a printed area. The purpose of the static display is to provide instructions for using and controlling the active display. The active display may provide restaurant menu item listings, advertisements, news headlines, sports, weather, movie schedules, and entertainment news. The notification function of the pager, such as by light or audible alert, is not interrupted by the active display information, and continues to operate even when the active display is turned off by the user.

A significant disadvantage of the Sibbitt device is that each pager must be programmed with the appropriate entertainment or other information. This would be a time-consuming chore for the employees of the restaurant, and the associated cost would offset the revenue gains that might be felt as a result of fewer customers leaving due to a long service wait time. In addition, the need to program each pager with the appropriate information would limit the currency of the information being displayed. The cost and time involved would discourage frequent updates. What is desired then is a system that would provide entertainment and other information to customers or other service recipients waiting for service, while reducing or eliminating the programming time and cost associated with the update of information displayed by prior art devices. In addition, it would be highly desirable to provide a means of delivering advertising information by such a device, including either or both of third-party advertising and the advertising of the restaurant or other provider that is supplying the paging system for the use of its customers or other service recipients.

SUMMARY OF THE INVENTION

The present invention is directed to a pager and mobile communication system that overcomes the limitations of the prior art by facilitating automatic updates and remote sensing control of individual pagers. The result is the display of information with a potential for a much higher level of currency than prior art systems. In addition, the system allows for the reaping of an additional benefit in the form of third-party advertisers purchasing advertising displayed through the system.

In contrast to prior art devices, the system comprises a three-tier communications network in order to implement this functionality: a master unit maintained by the pager service provider, which controls the entire network; a plurality of base units with docking port bays in communication with the master unit, and preferably physically located at each service provider; and the various pager units that are distributed to customers and that communicate with the base units associated with that service provider. Information distributed from the master unit may be distributed universally to all base units, customized for each base unit, or a combination of both types of information may be employed.

In preferred embodiments, the individual pager units comprise a display and controls for interface with the service recipient, with the display and controls preferably integrated into a touchscreen. The pager units may be recharged by use of a docking port bay in conjunction with the base unit.

Because of the centralized structure of this system, the administrative and maintenance burden upon the service provider is minimized; in fact the service provider has no responsibility for programming or downloading information to any of the base units in the preferred embodiment, as these functions are performed automatically from the master unit by means of communication with the on-site base unit.

The arrangement between the paging system provider and the service provider may include the display of advertisements to the service recipients by means of the paging units. These advertisements may be directed to services offered by the service provider, thereby further increasing the value of the system to such service providers. The system thus not only serves to reduce lost revenue due to potential customers leaving to avoid long wait times, it may also be a source of positive revenue through advertising.

It is therefore an object of the present invention to provide for a pager and mobile communication system and method that entertains and informs the customers or other service recipients of a service provider during wait times.

It is a further object of the present invention to provide for a pager and mobile communication system and method that provides the capability for distributing highly current information and entertainment to the customers or other service recipients of a service provider.

It is also an object of the present invention to provide for a pager and mobile communication system and method that minimizes the burden upon a service provider associated with providing a paging and communication capability to its customers or other service recipients.

It is also an object of the present invention to provide for a pager and mobile communication system and method that provides for third-party advertisements to be distributed to the customers or other service recipients of a service provider.

These and other features, objects and advantages of the present invention will become better understood from a consideration of the following detailed description of the preferred embodiments and appended claims in conjunction with the drawings as described following:

DETAILED DESCRIPTION OF THE PREFERRED EMBODIMENTS

Figure 1:
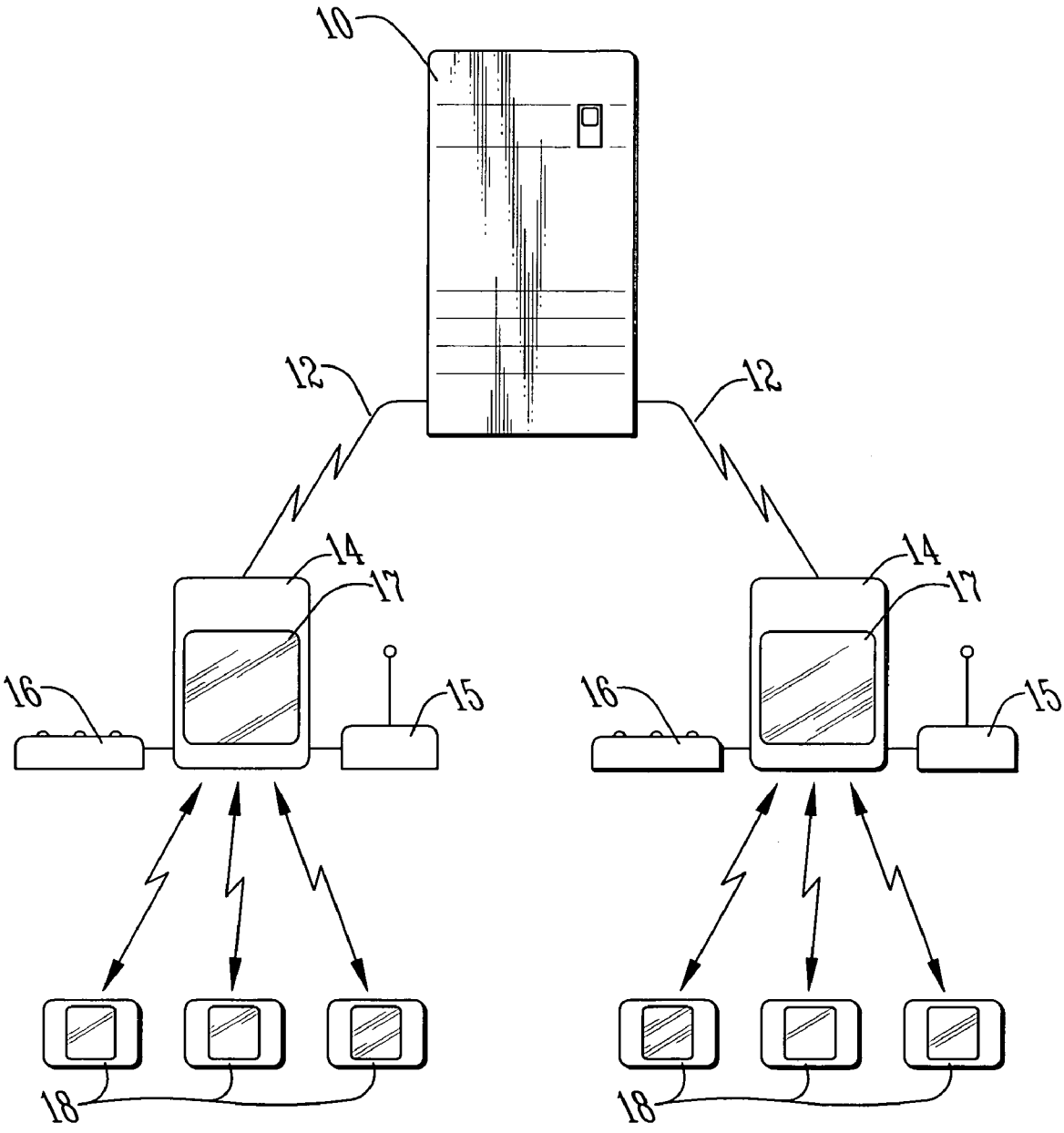
FIG. 1 is a block diagram depicting major components of a preferred embodiment of the present invention.

With reference now to FIG. 1, a preferred embodiment of the preferred invention may be described. The preferred embodiment comprises three distinct classes of components: a master unit 10, a plurality of base units 14, and a plurality of pager units 18 associated with each base unit 14. Master unit 10 is preferably physically located at a site maintained by the paging system provider. Master unit 10 may preferably be implemented as a microprocessor-based computer server of conventional type as are known in the art. Master unit 10 also preferably comprises various software components in order to perform the functions as described following.

Master unit 10 communicates with base units 14 by means of communications network 12. This communication linkage may be of any of various types, including landline communications as well as broadcast communications. In the preferred embodiment, communications network 12 is the Internet, and master unit 10 is configured as an "on-line appliance," that is, as a computer that is capable of communicating with other computers connected to the Internet in an automated fashion. Various means for communicating over the Internet may be employed in various embodiments, including traditional telephone line modems, broadband telephone and cable communications, and wireless and satellite-based communications.

Base units 14 are preferably situated at a physical site controlled by each service provider that is a subscriber to the pager service, for example, a restaurant. While only two base units 14 are shown in the illustrated embodiment of FIG. 1 for the sake of clarity, the preferred embodiment encompasses any number of base units 14 used with the invention, each corresponding to a restaurant, healthcare provider, or other service provider. The service provider may in fact be any entity that has customers that are required to wait at certain times for a service to be received. In the preferred embodiment, base unit 14 is a dedicated electronic device constructed for the specific purpose of providing the functionality provided herein. In alternative embodiments, however, base unit 14 may be a computer server or personal computer of conventional type, with appropriate hardware and software to implement the various functions of base unit 14 as will be described following. In either case, base unit 14 is configured such that it may communicate via communications network 12 with master unit 10. In the preferred embodiment, each base unit 14 is individually addressable by master unit 10 over communications network 12.

Base unit 14 comprises base radio frequency (RF) transceiver 15, the purpose of which is to provide remote, wireless communications with the pager units 18 associated with that particular base unit 14. In the preferred embodiment, base RF transceiver 15 is an integrated component of base unit 14, although it may in alternative embodiments be implemented as a add-on board or external hardware device added to a personal computer base unit 14. In the preferred embodiment, base RF transceiver 15 allows for two-way communications between base unit 14 and its associated pager units 18, although in alternative embodiments the communications may be of a one-way nature, originating at base unit 14 and being transmitted to the associated pager units 18. Base RF transceiver 15 preferably operates in the 900 MHz range as generally used in the United States for comparable devices, but other frequencies may be used in alternative embodiments as allowed or required by applicable communications regulations in any particular jurisdiction. In the preferred embodiment, base unit 14 also comprises base touchscreen 17, which allows a particular pager unit 18 to be signaled manually from base unit 14. Alternatively, or in addition to base touchscreen 17, a keypad may be used as an input control means, or base unit 14 may be configured to communicate with an in-house telephone network such that an operator may use a telephone keypad to signal a particular pager unit 18 via base unit 14.

Also operating in conjunction with base unit 14, either as a separate component or an integrated component as in the preferred embodiment, is docking port 16. In the case that docking port 16 is designated as a separate component from base unit 14, docking port 16 is preferably physically located in a site adjacent to the corresponding base unit 14, although in other alternative embodiments these components may be situated remotely from each other. In the restaurant environment, for example, docking port 16 should preferably be located in an area that is easily accessible to the restaurant host, hostess, or other person responsible for distributing pagers to waiting customers. The function of docking port 16 is to provide a recharging station for pager units 18. Preferably, pager units 18 are stored in docking port 16 when not in use, to be maintained in a fully charged state until just prior to distribution to a customer or other service recipient. It may be noted that docking port 16 may be omitted entirely in certain alternative embodiments, such that each pager unit 16 is provided with its own on-board recharging system, or where disposable batteries are used to power each pager unit 16.

Pager units 18 are preferably sized to be easily carried by an individual customer or other service recipient. Pager units 18 include wireless communications means for communication with an associated base unit 14. Although in FIG. 1 only three pager units 18 are illustrated for use in connection with each base unit 14 for the sake of clarity, any number of pager units 18 may be employed for use in connection with each base unit 14 in the preferred embodiment. A sufficient number of pager units 18 should be maintained on hand such that each customer or other service recipient who is expected to simultaneously wait may be given one by the service provider. In the preferred embodiment, a greater number of pager units 18 may be held on hand such that some units may be re-charging while other pager units 18 are in use. Docking port 16 should comprise a sufficient number of recharging bays to match the number of pager units that are expected to require a simultaneous re-charging, which will depend upon the nature of the service provider's business and the expected number of waiting customers or other service recipients at peak flow times. At certain restaurants, for example, weekend nights may be far busier than other times, and thus the appropriate number of pager units 18 for use with the system will far exceed the number needed at all other times during the restaurant's operation.

Figure 2:
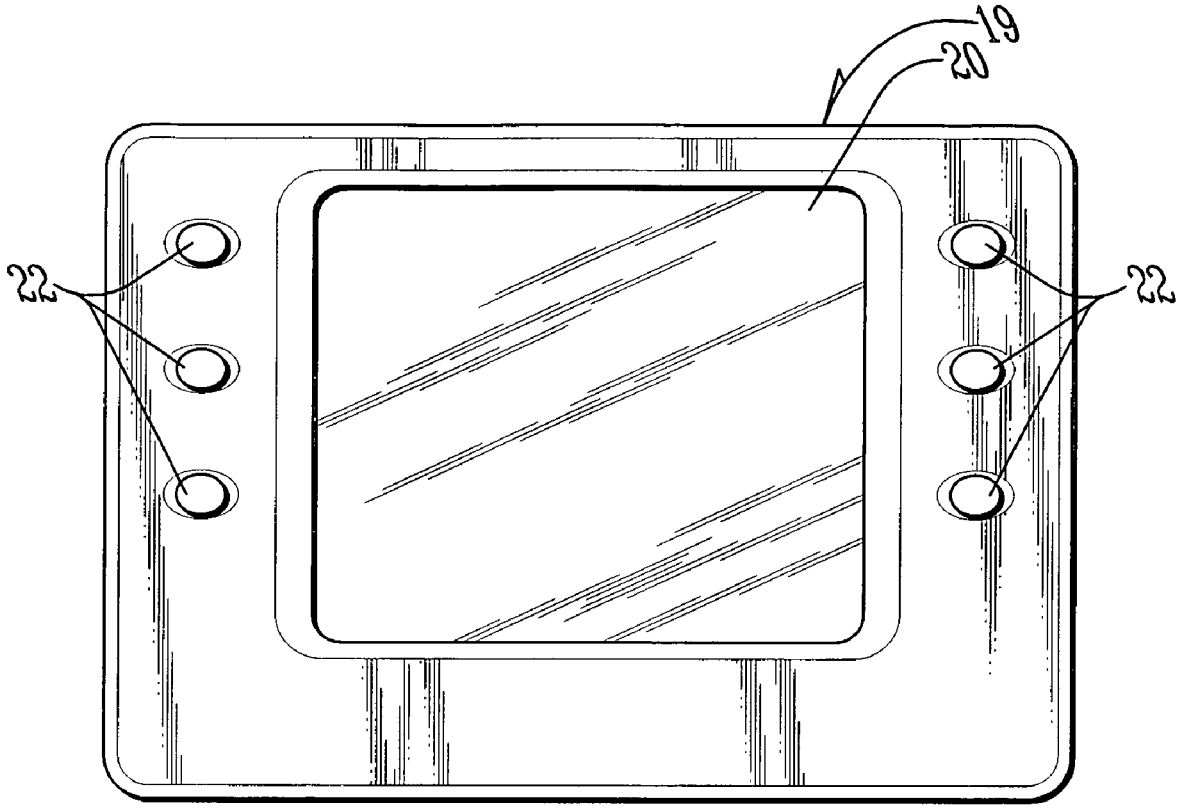
FIG. 2 is a top plan view of a pager unit according to a preferred embodiment of the present invention.

Turning now to FIG. 2, the exterior components of pager unit 18 in a preferred embodiment of the present invention may now be described. Pager unit 18 is preferably contained in a shell 19 that is of a roughly square or rectangular shape, although any other shape could be implemented in alternative embodiments as desired. Shell 19 may be formed of various plastics, such as polystyrene, or many other plastics or other materials known in the art that will provide sufficient strength to protect the internal components of pager unit 18 during use. Pager unit 18 also comprises, in the preferred embodiment, lights 22 that provide a visually perceptible alert when pager unit 18 receives an appropriate alert signal from base unit 14. Such a signal may be sent, for example, when a table is available for a patron when the invention is used by a restaurant. Light-emitting diodes (LEDs) of various colors may be used to implement lights 22, as are known in the art. Lights 22 may be used in any desired arrangement in various preferred embodiments, and may light up in various patterns as desired. Lights 22 may physically protrude through or outside of shell 19, or may be located within shell 19 and be visible due to the use of a transparent or translucent material for the construction of shell 19. The latter arrangement is preferable due to the reduced likelihood of damage to the pager unit 18 if, for example, it is inadvertently dropped or if a liquid is spilled on its outer surface.

In the preferred embodiment, pager unit 18 further comprises a touchscreen 20 that preferably covers a large portion of the top surface of pager unit 18. In the preferred embodiment, touchscreen 20 is a 2.7" diagonal, QVGA (320×240 pixel), TFT (thin-film transistor) LCD (liquid crystal display) screen with 64 k color capability. Touchscreen 20 preferably also includes a backlight, as is known in the art for various types of LCD flat-panel screens. In alternative embodiments, a simple LCD display may be substituted for touchscreen 20. In this case, additional control mechanisms may optionally be provided on the face of pager unit 18, with openings sized therefor in shell 19, as appropriate. Such controls may include, for example, buttons, knobs, toggle switches, or slide switches. The purpose of these controls, as with the touch features of touchscreen 20, is to allow the service recipient to whom pager unit 18 is issued to communicate with base unit 14, possible purposes for which will be described following. In still other alternative embodiments, no control features may be used, in which case pager unit 18 is a passive device that does not provide for feedback or input from the service recipient to whom pager unit 18 is issued.

Touchscreen 20 may display, in the preferred embodiment, two different types of information. One type of information is static data, that is, information that is displayed on touchscreen 20 for a period of time and then removed. Static information may be viewable, for example, for a definite period, such as 10 seconds, before it is removed and replaced with alternative static data. Alternatively, the viewing of static data may be controlled by the user through touchscreen 20. The second type of data is scrolling data, that is, data that scrolls across a portion of the screen in a continuous fashion. Scrolling data may, in the preferred embodiment, be continuously updated at pager unit 18 through base unit 14, with the newest information being displayed first in the scrolling order. In alternative embodiments, static data and scrolling data may be displayed on two different screens, whereby the screen used for scrolling data is preferably a simple LCD screen rather than a touchscreen. Additionally, data and time information may be displayed in a portion of the display area of touchscreen 20. In alternative embodiments, data and time information may be included in scrolling data in a separate screen from the static data, or may be displayed in a third screen separate from the screens used for either static data or scrolling data.

Figure 3:
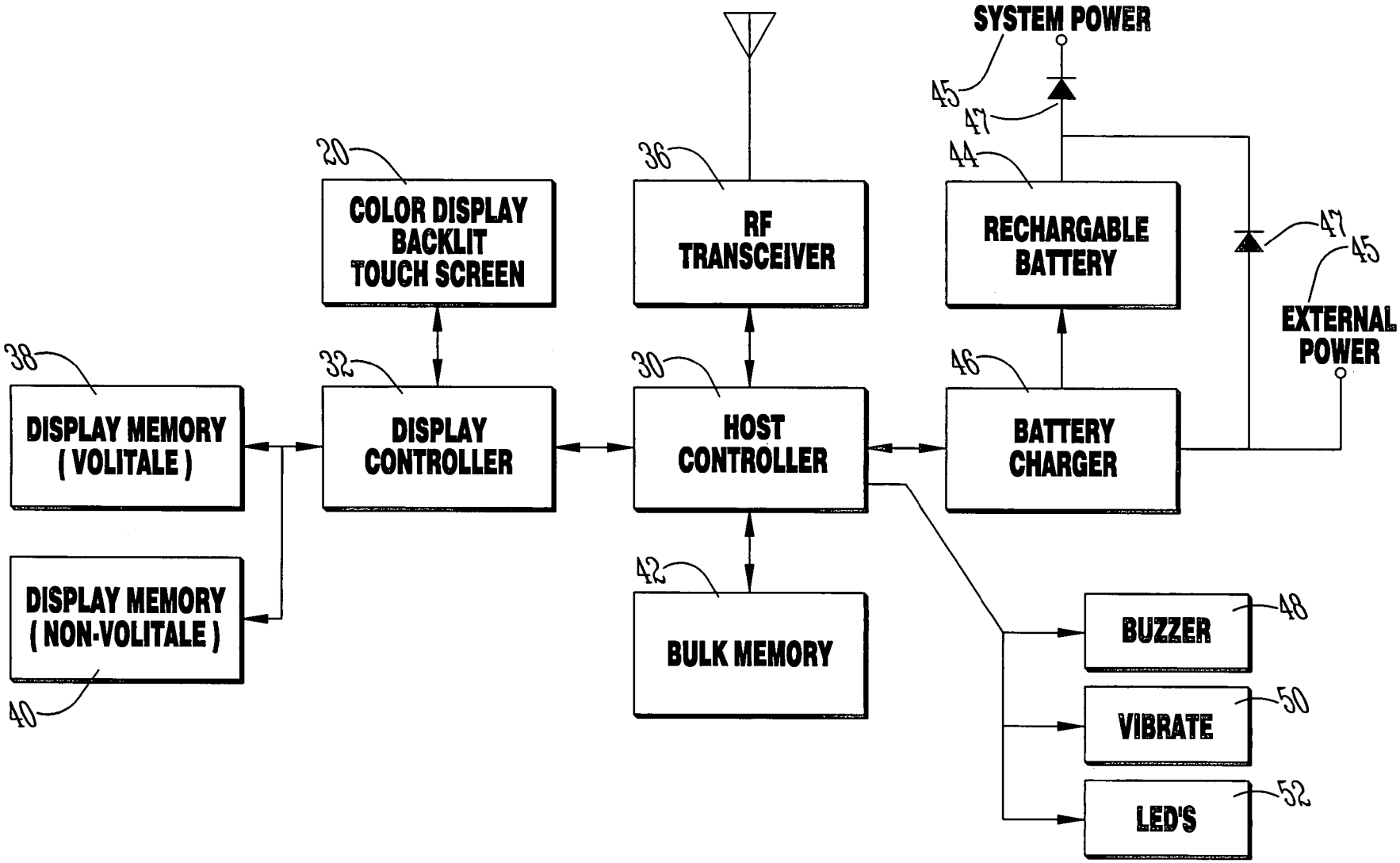
FIG. 3 is a schematic diagram of the electronic components of a pager unit according to a preferred embodiment of the present invention.

Referring now to FIG. 3, a preferred embodiment of the electronic components of pager unit 18 may now be described. Each of these components are arranged on a printed circuit (PC) board in the preferred embodiment. Pager host controller unit 30 is the control unit responsible for the coordination and receiving and transmitting of radio frequency (RF) data, the display of static data, the display of scrolling data, bulk data storage, battery charging, and alert indicators in pager unit 18. Pager host controller 30 may communicate with pager display controller 32, pager RF transceiver 36, battery charger 46, bulk memory 42, buzzer 48, vibrate unit 50, and LEDs 52 (which are, in the preferred embodiment, the means used to implement lights 22 of FIG. 2). Pager host controller 30 may be implemented with any appropriate microcontroller or microprocessor, as are known in the art and available from various manufacturers.

Pager bulk memory 42 is a non-volatile memory utilized to store static data for pager unit 18 as manipulated by pager host controller 30. This information is transmitted by pager host controller 30 to pager display controller 32 as needed for the display of static data. In the preferred embodiment, scrolling data is not stored at pager bulk memory 42, but is instead streamed to pager display controller 32 on demand. Pager bulk memory 42 may be implemented as a separate memory IC chip, or may be implemented as on-board memory available in certain microprocessors or microcontrollers as may be used to implement pager host controller 30.

Pager display controller 32 handles the display of both static and scrolling data to pager touchscreen 20 in the preferred embodiment. Pager display controller 32 may be implemented as one of any of the microprocessors or microcontrollers as are known in the art for driving LCD display units. Pager display controller 32 drives pager touchscreen 20 in a manner consistent with viewing by the human eye, including appropriate refresh rates and other factors. The static data is preferably updated on a predefined time period, such as, for example, every 10 seconds. Scrolling data is updated on an as-needed basis, as new scrolling data is received from base unit 14, which in turn receives information from master unit 10. Pager display controller 32 also receives data from pager touchscreen 20 concerning the location on pager touchscreen 20 where a user may have touched the screen, in order to calculate the appropriate response. The programming for pager display controller 32 is stored as firmware at pager non-volatile memory 40. Pager volatile memory 38 is used for display buffers, scratchpad memory, and related functions to support the operation of pager display controller 32. Various IC units for the implementation of pager volatile memory 38 and pager non-volatile memory 40 are known in the art, and, alternatively, the microprocessor or microcontroller used for the implementation of pager display controller 32 may have on-board memory that may be used as pager volatile memory 38 and pager non-volatile memory 40.

Pager RF transceiver 36 is used to transmit and receive RF data between pager unit 18 and base unit 14. Pager RF transceiver 36 is the conduit through which all data is transmitted to pager unit 18, whether the data is static, scrolling, or an alert signal indication. Upon reception of data at pager RF transceiver 36, pager host controller 30 calculates the appropriate path the data is to be routed internally within pager unit 18, and forwards the specified data or signal to the appropriate component of pager unit 18. In the preferred embodiment, the communications path is bi-directional, such that pager host controller 30 may utilize pager RF transceiver 36 to send a signal to base unit 14. This may be done, for example, in response to an operator manipulating pager touchscreen 20, the signal being processed by pager display controller 32 and an appropriate response signal being sent to pager host controller 30.

Battery charger 46 functions to control the charging of rechargeable battery 44 of pager unit 18. It functions in conjunction with power diodes 47 and external system power 45 (as may be implemented in the preferred embodiment as docking port 16, described in more particularity following). Battery charger 46 provides a constant voltage/current capability to ensure that neither overvoltage nor undervoltage charging of battery 44 occurs. Circuit designs to perform such functionality are known in the art. Rechargeable battery 44 is the main power source for pager unit 18 when it is not being recharged. Rechargeable battery 44 is preferably of the Lithium Ion (Li-Ion) type, which is believed by the inventors to provide adequate power density to the preferred embodiment of pager 18 for a minimum two-hour operational time between recharging sessions. Since it is intended that pager unit 18 will remain stored in a recharging state when not in use, this is believed adequate for most applications, although in alternative embodiments of the invention other types of batteries could be substituted if a longer use period between recharging sessions is foreseen.

Finally, pager unit 18 further comprises alert signal indicators in the form of pager buzzer 48, pager vibrate unit 50, and pager LEDs 52. In the preferred embodiment, pager vibrate unit 50 and pager LEDs 52 provide a tactile and visual alert, respectively, in response to an alert signal being received by pager unit 18 at pager RF transceiver 36 as processed by pager host controller 30. Thus the user may place pager unit 18 on his or her person, such as in a pocket, and will receive an alert signal by means of pager vibrate unit 50 even though the unit is not visible. Likewise, pager LEDs 52 will alert the user so long as pager unit 18 is placed in a location that is visible to the user. Pager buzzer 48 provides an audible signal to indicate that pager unit 18 is no longer in range to exchange an RF signal with base unit 14. The buzzer continues to provide an audible signal until pager unit 18 is moved back into communications range with base unit 14. Thus the user is alerted to a situation whereby pager unit 18 would not be capable of receiving a page alert signal.

Figure 4:
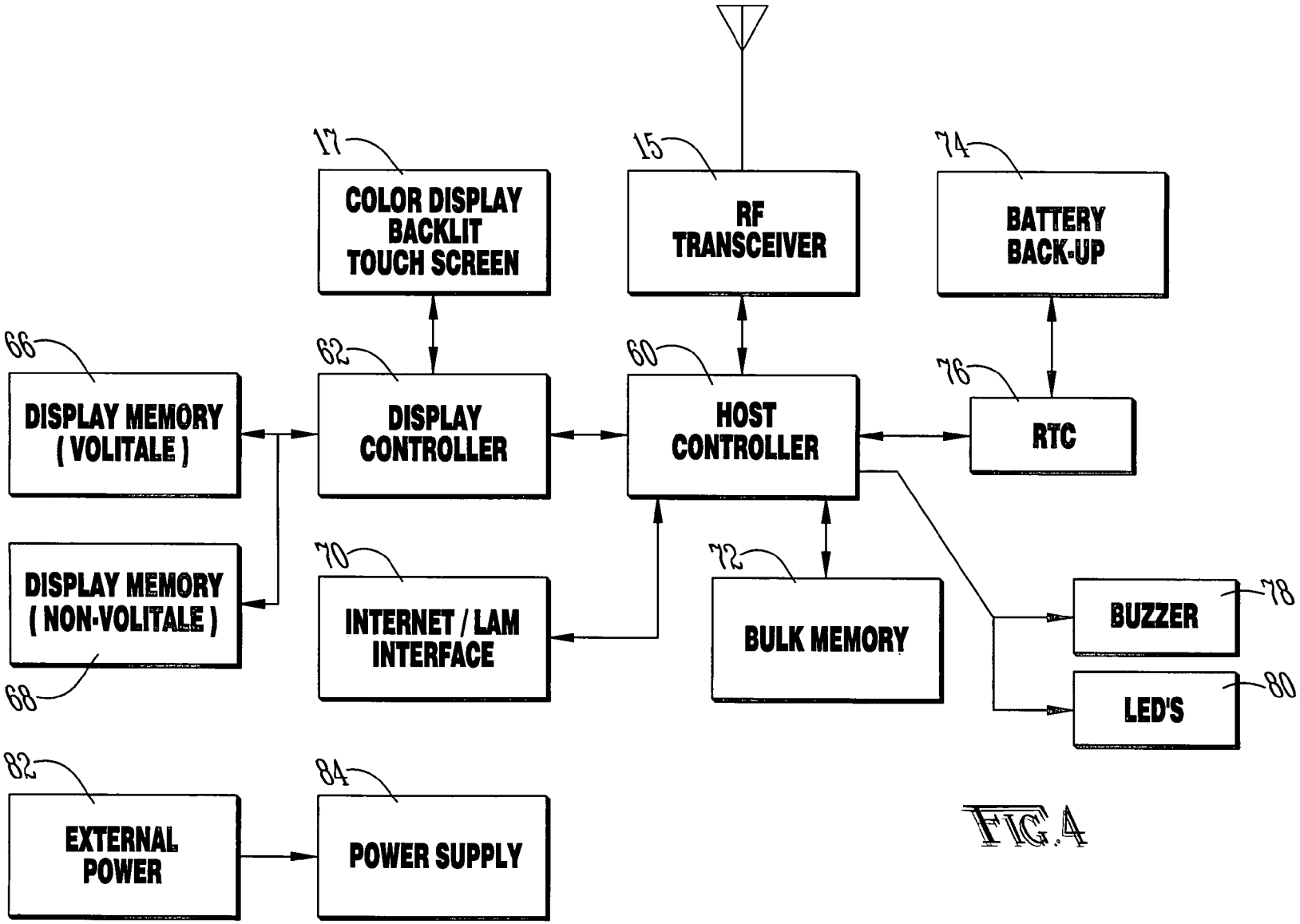
FIG. 4 is a schematic diagram of the electronic components of a control portion of a base unit according to a preferred embodiment of the present invention.

Turning now to FIG. 4, a preferred embodiment of the electronic components of the control portion of base unit 14 may now be described. Each of these components are arranged on a PC board in the preferred embodiment. Base host controller 60 operates to coordinate and process, for example, the receiving and transmitting of RF data, display of the user graphical user interface (GUI) at base touchscreen 17 by means of base display controller 62, display of scrolling data, bulk data storage, coordination of the Internet interface, real-time clock (RTC) data, and alert indication signals. To perform these functions and others, base host controller 60 communicates with base display controller 62, base RF transceiver 17, RTC unit 76, base bulk memory 72, base Internet/local area network (LAN) interface 70, base buzzer 78, and base LED 80. Various microprocessors and microcontrollers may be used to implement base host controller 60 in various embodiments, such devices being known in the art.

Base display controller 62 functions to handle the display of information through the GUI at base touchscreen 17 and scrolling data. Base display controller 62 drives the display of information in a manner consistent with viewing by the human eye, including such issues as an appropriate refresh rate. The GUI may provide all functionality through which the operator of base unit 14 may enter control information, such as selection of appropriate pager units 18 for various signals, including an alert signal to page a customer or other service recipient, and enabling and disabling various particular pager units 18 for operation within the system. Scrolling data that is entered through the GUI at base touchscreen 17 may be updated on an as-need basis. Preferably, data is displayed at base touchscreen 17 as it is being transmitted via base RF transceiver 17 to a pager unit 18. In the preferred embodiment, base touchscreen 17 is a 2.7" diagonal touchscreen with 64 k color capability, such as that described above with respect to pager touchscreen 20. Other types of touchscreens may be employed in alternative embodiments, however, and the touchscreen may be replaced with other control and user interface means in still other alternative embodiments. The programming for base display controller 62 is stored as firmware at base non-volatile memory 68. Base volatile memory 66 is used for display buffers, scratchpad memory, and related functions to support the operation of base display controller 62. Various IC units for the implementation of base volatile memory 66 and non-volatile memory 68 are known in the art, and, alternatively, the microprocessor or microcontroller used for the implementation of base display controller 62 may have on-board memory that may be used as base volatile memory 66 and base non-volatile memory 68.

Base RF transceiver 17 is employed to transmit and receive information via an RF data link with each associated pager unit 18. All data to be transmitted to or from base units 18 by pager units 18 passes through base RF transceiver 17, including static data, scrolling data, and alert signals. Internet/LAN interface 70 is the means by which base unit 14 communicates with master unit 10, preferably over the Internet. Internet/LAN interface 70 provides for the receipt by base unit 14 of both static and scrolling data from master unit 10. In the preferred embodiment, Internet/LAN interface 70 is a T10/100 LAN interface, with adequate buffering and control logic to operate TCP/IP communications, as is understood in the art.

Base bulk memory unit 72 is used to store static data received through Internet/LAN interface 70 from master unit 10. Base host controller 60 receives static data from master unit 10, preferably on a particular schedule, such as hourly or daily, and stores the information at base bulk memory unit 72 for later transmission to the associated pager units 18 by means of base RF transceiver 15. It should be noted that in the preferred embodiment, only static data is stored at base bulk memory 72, not scrolling data, which is transmitted on an as-needed basis from master unit 10.

RTC unit 76 provides an on-board clock function for base unit 14. It provides time and date information to base host controller 60, which is preferably propagated thereby to pager units 18. Battery back-up 74 is employed to ensure that accurate time and date information is maintained, even if base unit 14 is powered down or power is inadvertently lost to the system. Power supply 84 may be of any standard sort used to provide a regulated power source to an electronic system, and may receive power from external power source 82, such as a wall outlet providing 120V AC power.

The preferred embodiment of base unit 14 is provided with two indicators, buzzer 78 and LEDs 80, each of which are driven by base host controller 60. The function of buzzer 78 is to provide an audible alert if a pager unit 18 that is active in the system monitored by base unit 14 has moved out of RF communication range. The audible alert will preferably continue to sound until such time as each active pager unit 18 is brought back within RF communication range of base unit 14. LEDs 80 are used to provide an indication that power is being supplied to base unit 14 and that base unit 14 is operating in a normal, error-free mode.

Figure 5:
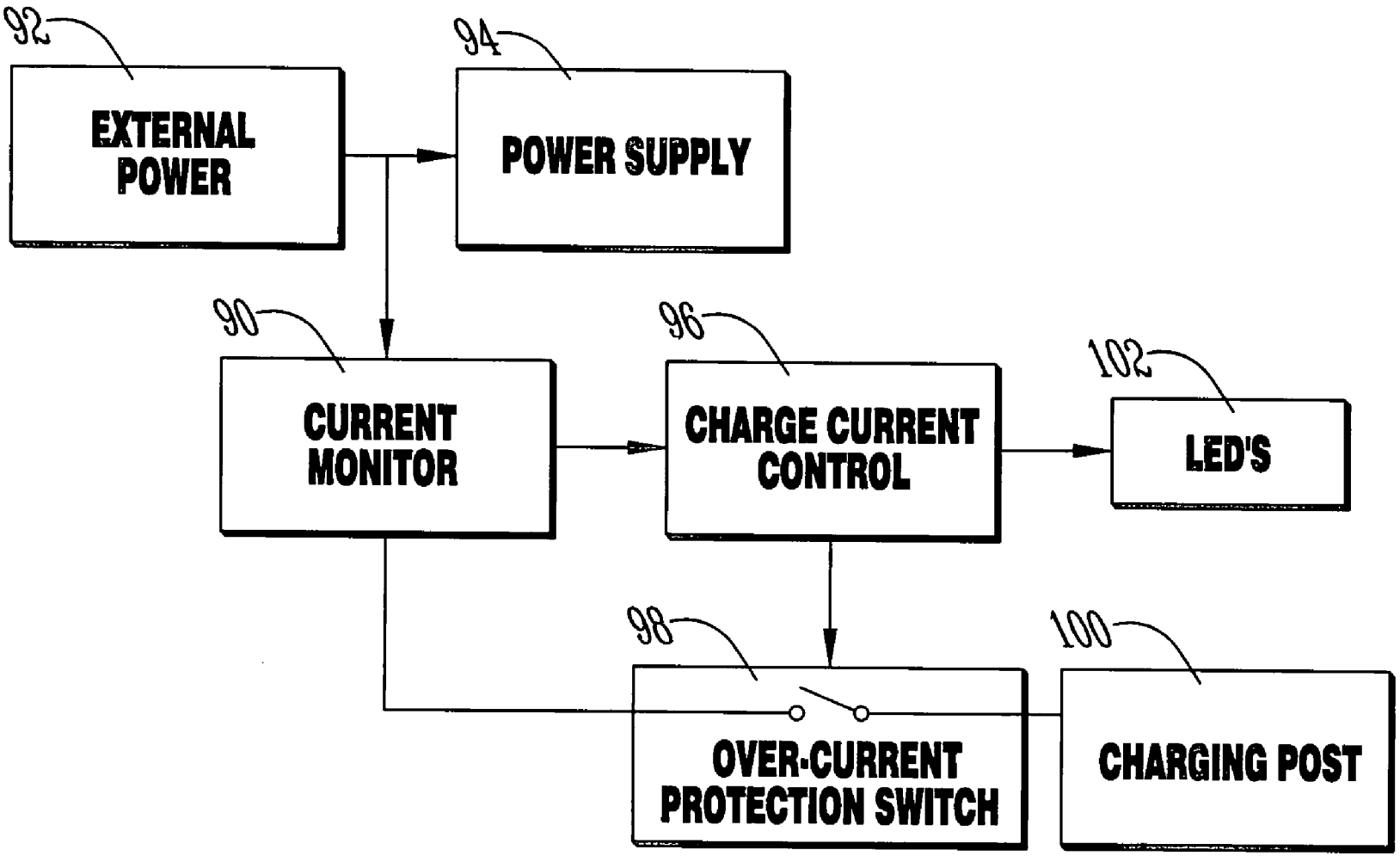
FIG. 5 is a schematic diagram of the electronic components of a docking port portion of a base unit according to a preferred embodiment of the present invention.

Turning now to FIG. 5, a preferred embodiment of the electronic components of the docking port 16 portion of base unit 14 may now be described. Current monitor 90 operates to measure the amount of current that is being consumed at any given moment at docking port 16. This information is gathered by measuring the current input from power supply 94, which provides regulated power to docking port 16. Power supply 94 receives power from docking port external power source 92, which may preferably be a wall outlet providing 120V AC power. Based on the reading from current monitor 90, charge current control unit 96 operates to either open or close over-current protection switch 98. Such switches are known in the art. Over-current protection switch 98 is maintained as closed if the charge current is at or below the maximum allowable charging current value, as determined at charge current control 96. Over-current protection switch 98 is opened by charge current control 96 if the charge current measured at current monitor 90 is above the maximum allowable charging current value. Charging post 100 is used as the electrical connection means between the charging power provided by docking port 16 and each pager unit 18. Although only one charging post 100 is illustrated in FIG. 5 for the sake of clarity, docking port 16 may include any number of charging posts 100 in various embodiments of the invention, depending upon the number of pager units 18 that are required to be charging simultaneously for a given application. Docking port LEDs 102 are used to provide feedback to the user concerning the present state of the charging stand, such information in the preferred embodiment including whether the system is at a normal charge level or an over-current charge level, and whether power is being delivered to docking port 16.

It may be seen from the above description that the preferred embodiment of the present invention allows for a highly automated system whereby service recipients may utilize pagers with standard paging functions while also receiving current information or entertainment by means of their pagers. Data such as menu information, entertainment information, and news may be transmitted to the customer or other service recipient, thereby reducing the frustration of waiting for a service to be received. Due to the control of the overall system by master unit 10, the information provided may be of a highly current nature, particularly the scrolling data provided in the preferred embodiment. The interactive nature of the invention in certain embodiments, whereby information may be both sent and received by pager 18, allows for the implementation of games and other interactive entertainment, such as trivia contests, using pager units 18. Such features may not only serve to alleviate the tedium of a long wait for service, but may serve as a positive incentive for a service recipient to choose a particular service provider if he or she knows that this form of entertainment will be available.

In addition to the above types of information, advertising may be delivered by means of the preferred embodiment, either as advertising for the service provider or a third party. In an example of a third-party advertising arrangement, an advertiser contracts with the pager system provider to deliver advertising to the customers of one or more of its paging system subscribers. The advertising information is then delivered to master unit 10. This information is transferred to the appropriate base unit or units 14 that correspond to the subscribers who will receive the advertising information, and, if it is to be displayed as static data, may be stored by each appropriate base host controller 60 at base bulk memory 72. The information is then further transmitted by base RF transceiver 17 to each active pager unit 18 through its pager RF transceiver 36. Each pager host controller 30 receives the information, and passes it to the associated pager display controller 32 for display at pager touchscreen 20. Advertising revenue gained through the use of this system with third-party advertisers may preferably be shared with the subscriber as an incentive to subscribe to the system and to accept third-party advertising. Software maintained at master unit 10 may be employed to track the locations to which advertising and sent and thereby automatically calculate appropriate royalties or incentives for each subscriber. As a result, the subscriber benefits from the use of the system not only in the reduction of lost revenues from customers who would have refused to wait for service without the presence of the system, but also through revenues generated by third-party advertising that offset the cost of subscribing to the system. The centralized nature of the advertising service facilitated by the inclusion of master unit 10 renders the provision of advertising a simple matter for individual paging system subscribers; in fact, the subscriber may in the preferred embodiment receive the advertising automatically, without any necessary processing or reconfiguration of its base unit 14 or associated system components.

The present invention has been described with reference to certain preferred and alternative embodiments that are intended to be exemplary only and not limiting to the full scope of the present invention as set forth in the appended claims.

We claim:

1. A paging and communications apparatus, comprising:

(a) a master unit operable to store an informational message, wherein said informational message comprises a static data set and a scrolling data set;

(b) a communications network connected to said master unit;

(c) a plurality of base units, each of said base units connected to said communications network wherein said base units may receive the informational message from said master unit, and wherein each of said base units comprises:

(i) an input interface operable to receive one of a plurality of pager identifiers;

(ii) a processor operable to receive a pager identifier and generate an alert signal associated with the pager identifier; and (iii) a transmitter operable to transmit the pager identifier, the informational message, and the alert signal; and (d) a plurality of pager units, each of said pager units identified with one of the pager identifiers, wherein each of said plurality of pager units comprises:

(i) a receiver operable to receive the pager identifier, informational message, and the alert signal from an associated one of said base units;

(ii) a processor operable to generate an alert if the alert signal is associated with the pager identifier associated with a particular pager unit;

(iii) a display unit operable to display the informational message, and (iv) wherein the display unit of each of the plurality of pager units comprises a first display and a second display, and wherein said displaying step comprises the display of the static data set on the first display and the display of the scrolling data set on the second display.

2. The apparatus of claim 1, wherein said display unit of each of said pager units is a video display screen.

3. The apparatus of claim 2, wherein said input interface is a video display touchscreen.

4. The apparatus of claim 1, wherein said informational message comprises a third-party advertisement.

5. The apparatus of claim 1, wherein each of said base units further comprises a bulk memory unit operable to store said static data set.

6. The apparatus of claim 1, wherein each of said base units further comprises a receiver operable to receive a response message from each of said pager units associated with said base unit, and each of said pager units further comprises:

(a) a transmitter operable to transmit said response message to that one of said base units associated with said pager unit; and (b) a control operable to input said response message from a user.

7. The apparatus of claim 6, wherein said control and said display unit comprise a video display touchscreen.

8. A method of delivering a paging signal in conjunction with an informational message, said method comprising the steps of:

(a) storing an informational message, comprising a static data set and a scrolling data set, at a master unit;

(b) delivering the informational message to at least one of a plurality of base units in communication with the master unit;

(c) delivering the informational message to each of a plurality of pager units in communication with each of the plurality of base units that received the informational message from the master unit;

(d) receiving at an input interface of at least one base unit a pager identifier;

(e) sending an alert signal to that one of the plurality of pager units associated with the pager identifier;

(f) generating one of a visual, audible, and tactile alert at that one of the plurality of pager units associated with the pager identifier, and (g) wherein the display unit of each of the plurality of pager units comprises a first display and a second display, and wherein said displaying step comprises the display of the static data set on the first display and the display of the scrolling data set on the second display.

9. The method of claim 8, further comprising the step of displaying the informational message at a display unit associated with each pager unit in communication with each of the plurality of base units that received the informational message.

10. The method of claim 9, comprising the step of storing the informational message at each of the plurality of base units that received the informational message.

11. The method of claim 8, further comprising the steps of:

(a) receiving a response message at a control associated with at least one pager unit; and (b) transmitting the response message from such pager unit to the associated one of the plurality of base units.

12. The method of claim 11, wherein the control and the display unit of each of the plurality of pager units comprise a video display touchscreen.

* * * * *